United States Patent [19]

Reisem

[11] 4,385,280

[45] May 24, 1983

[54] LOW RELUCTANCE LATCHING MAGNETS

[75] Inventor: Daniel E. Reisem, Maplewood, Minn.

[73] Assignee: Minnesota Mining and Manufacturing Company, Saint Paul, Minn.

[21] Appl. No.: 246,626

[22] Filed: Mar. 23, 1981

Related U.S. Application Data

[63] Continuation-in-part of Ser. No. 34,381, Apr. 30, 1979, Pat. No. 4,321,652.

[51] Int. Cl.[3] ..... H01F 7/08

[52] U.S. Cl. ..... 335/230; 335/234

[58] Field of Search ..... 335/229, 234, 236, 304, 335/230

[56] References Cited

U.S. PATENT DOCUMENTS

| | | | |
|---|---|---|---|
| 3,154,728 | 10/1964 | Bordenet | 335/236 X |
| 3,379,214 | 4/1968 | Weinberg | 335/234 |
| 3,461,354 | 8/1969 | Bollmeier | 317/156 |
| 3,775,715 | 11/1973 | Bosch et al. | 335/234 |

*Primary Examiner*—George Harris

*Attorney, Agent, or Firm*—Cruzan Alexander; Donald M. Sell; William D. Bauer

[57] ABSTRACT

An electromagnetic device having an armature mounted in the gap of a ferromagnetic core for selective contact of either of opposed pole faces. A source of latching flux retains the armature in contact with either of the pole faces while a flux return bracket conducts flux between the armature and the source of latching flux. The source of latching flux has a surface area perpendicular to the flux path greater than the length along the flux path creating a low reluctance path for a portion of the operating flux.

4 Claims, 2 Drawing Figures

LOW RELUCTANCE LATCHING MAGNETS

RELATED APPLICATON

This application is a continuation-in-part of U.S. Ser. No. 034,381, Baker et al, LOW VOLTAGE TRANSFORMER RELAY, filed Apr. 30, 1979 now U.S. Pat. No. 4,321,652.

BACKGROUND OF THE INVENTION

1. Field of the Invention

This invention relates generally to an electromagnetic device and specifically to a low voltage transformer relay.

2. Description of the Prior Art

Electromagnetic devices such as the magnetic remote control switch described in U.S. Pat. No. 3,461,354 to Bollmeier may be used to control high voltage, high current electrical loads by remotely located low voltage switches. This type of remote switching device is generically called a low voltage transformer relay.

One of the principle advantages of such low voltage transformer relays is the ability to control the electrical load by a multiplicity of low voltage switches located in various locations. For example, if a low voltage transformer relay is used to control a lighting load within a room, one or more low voltage switches located within the room as well as one or more remotely located low voltage switches may be used to control the load. Such a configuration allows one to extinguish all of the lights within a building from a single remote location having a low voltage circuit to each transformer relay.

There is a continuing need, however, to reduce the fabrication costs and improve the electrical and mechanical performance of such low voltage transformer relays.

SUMMARY OF THE INVENTION

An electromagnetic device having a ferromagnetic core with opposed core faces defining a gap. A source of operating flux establishes a magnetic field in the gap. An armature is mounted for selective contact with either of the pole faces. A source of latching flux retains the armature in contact with either of the pole faces. A flux return bracket contacts the source of latching flux and contacts the armature for conducting flux therebetween. The source of latching flux has a surface area A perpendicular to the flux path and a length L along the flux path such that the factor L/A is less than 1.

The source of latching flux may be a permanent magnet and, in one embodiment, may be a permanent magnet made of domain size ferrite particles dispersed in a flexible nonmagnetic binder.

The low reluctance of the source of latching flux along with the flux return bracket and the armature provide a low reluctance path for a portion of the operating flux. This construction enables a reduction in operating flux in the gap which in turn permits larger gaps by about 50%. This construction substantially improves the electrical and mechanical performance of electromagnetic devices and, in particular, low voltage transformer relays.

DESCRIPTION OF THE PREFERRED EMBODIMENTS

Figure 1:
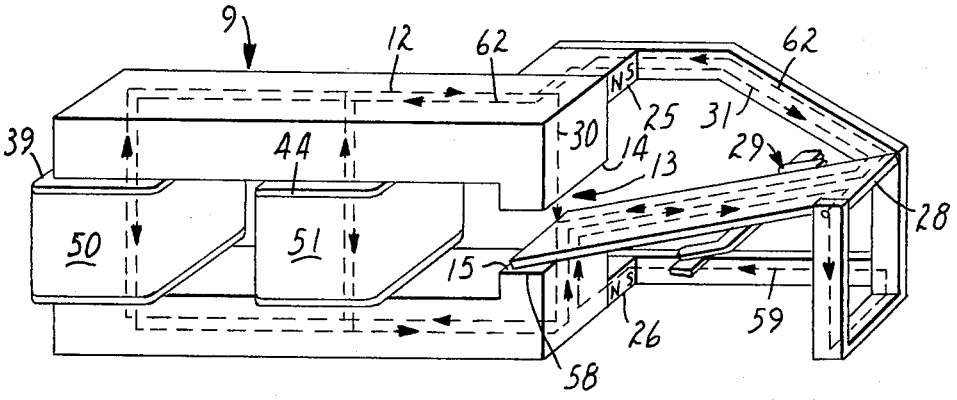
FIG. 1 is an isometric view of a low voltage transformer relay constructed in accordance with the present invention.

The low voltage transformer relay illustrated in FIG. 1 includes a core 9, a primary winding 50 wound on spool structure 39, a secondary winding 51 wound on spool structure 44, sources of latching flux 25 and 26, a flux return bracket 27 and an armature 28. The sources of the operating flux 12 are the primary winding 50 and the secondary winding 51. This operating flux 12 is carried by the core 9. Sources of latching flux 25 and 26 are positioned between the ferromagnetic core 9 and the flux return bracket 27, one on either side of gap 13. Preferably the sources of latching flux 25 and 26 are permanent magnets, such as Plastiform flexible permanent magnets available from Minnesota Mining and Manufacturing Company of St. Paul, Minn. These flux sources generate magnetic flux conducted through core 9, armature 28 and flux return bracket 27 to form a magnetic circuit which will latch the armature 28 to one of the pole faces 14 or 15. The orientation of the latching flux sources is illustrated in FIG. 1. The latching magnets 25 amd 26 have like poles in contact with ferromagnetic core 9, and opposite like poles in contact with the flux return bracket 27. In the quiescent state with the source of operating flux 12 inactivated, the latching flux imparts a force sufficient to retain the armature 28, which actuates load switch 29, in contact with one of the pole faces 14 or 15. The path of latching flux is shown by flux line 59 and 62.

Transfer of the armature 28 from one pole face, e.g. pole face 15, to the other, e.g. pole face 14, is accomplished by activating the source of the operating flux 12. Since the armature 28 is attracted to the pole face that conducts the greatest net flux, transfer is initiated when flux in gap 13 exceeds the flux in the interface 58 between the armature 28 and the core 9. The main portion of the operating flux 12 generated by the source of the operating flux traverses the gap 13 and then the thin dimension of the armature 28 and finally the interface 58 between the armature 28 and the pole face 15 to which the armature 28 is latched. The path of the main portion of the operating flux is shown by flux line 30. A fraction of the operating flux, shown by flux path 31, may traverse one source of latching flux, e.g. source of latching flux 25, and rejoin the main operating flux in the armature 28 by circulating through flux return bracket 27 and through the long dimension of the armature 28. The main portion of the operating flux 30 and the fractional portion 31 of the operating flux together constitute the total operating flux.

During armature transfer, the total operating flux builds in the interface 58 between the armature 28 and the pole face 15. This total operating flux opposes the flux generated by the sources latching flux 25 and 26. The net flux at the interface 58 is the difference between the latching flux and the total operating flux. To accomplish transfer of the armature 28 to the opposite pole face, pole face 14, the total operating flux (30 and 31) in the interface 58 must increase until the difference between the latching flux 59 and 62 and the total operating flux (30 and 31) is slightly less than the main operating flux 30 in the gap 13. This is in contrast to prior art low voltage transformer relays, wherein leakage flux completely by-passes the gap 13 and interface 58 and does not subtract from the latching flux, which would help to overcome the latching force. In the prior art relay, the operating flux in interface 58 must itself be slightly more than one-half the latching flux with no contribution from flux traversing a flux path 31. It is seen that if the operating flux through path 31 is equal to that through path 30, the operating flux through gap 13 in the relay of the present invention need only be slightly more than two-thirds the prior art value for armature transfer. This reduction in operating flux in gap 13 permits larger gaps by 50% than could be used in the prior art relay.

The sources of latching flux 25 and 26 are positioned in the present invention and the core 9 is constructed to minimize total magnetic reluctance in the low voltage transformer relay. By shaping the source of latching flux 25 and 26 such that the source of latching flux 25 and 26 present a large surface area A perpendicular to the flux path and a short path length L in the direction of the flux, the reluctance factor L/A to operating flux can be minimized, preferably to a value less than one; $L/A<1$. By lowering the reluctance of the source of latching flux 25 and 26, path 31 is provided for operating flux to pass through the sources of latching flux, the flux return bracket 27 and the armature 28 thus confining flux, which in the prior art has leaked from the magnetic circuit, to a magnetic circuit where it contributes to performance. The source of latching flux may be split, as illustrated in FIG. 1 with sources of latching flux 25 and 26, or the source of latching flux may be concentrated in either source of latching flux 25 or source of latching flux 26. Where multiple sources of latching flux (25 and 26) are utilized, the length L in the direction of the flux is the length of the individual sources of latching flux (either 25 or 26) while the surface area A perpendicular to the flux path is the sum of all of the surface areas taken together (both 25 and 26 together).

Figure 2:
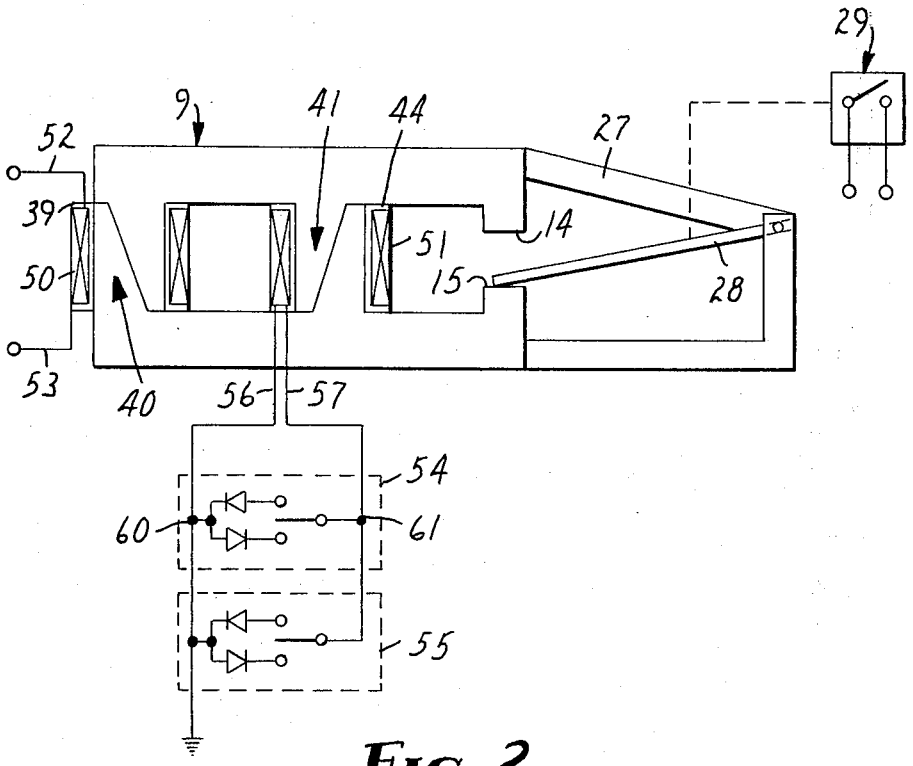
FIG. 2 is a cross-sectional elevation view of the low voltage transformer relay of FIG. 1, including electrical connections.

In FIG. 2 the electrical connections to the low voltage transformer relay are shown. A primary winding 50 and a secondary winding 51 are wound on spool structures 39 and 44. During assembly the spools are oriented such that the secondary winding 51 surrounds the second leg 41 of the core 9, and the primary winding 50 surrounds the first leg 40 of the core. Also illustrated are the flux return bracket 27 and the armature 28.

In operation the primary winding 50 is connected to a source of A.C. voltage through leads 52 and 53. The A.C. voltage across the primary winding 50 induces an A.C. voltage on the secondary winding 51.

Rectifying switches 54 and 55, are connected to the secondary winding through leads 56 and 57 which permits half wave current to flow in the secondary winding 51 opposing the primary flux and resulting in operating flux appearing in the flux paths 30, 31 of the device. The rectifying switches (54 and 55) include single pole double throw switches of the momentary contact type, and a pair of diodes. The cathode of one diode and the anode of the other diode of the pair of diodes associated with switch 54 are connected to one terminal 60 of the switch 54. The opposite terminals of each diode are connected to the switched terminals of switch 54. The common terminal 61 of the switch 54 is connected to the secondary winding lead 57. The second switch 55 is connected similarly. In operation, the switches are used to selectively connect one of the diodes in series with the secondary winding 51. In this position, an electrical circuit is completed which allows the induced voltage in the secondary to establish an unidirectional current in the coil and a corresponding magnetic field in the core 9. This is the source of operating flux 12 to transfer the armature 28. The two positions of the switches correspond to the two positions of the armature 28. As illustrated in FIG. 2, an arbitrary number of rectifier switches 54, 55 may be connected in parallel to control the low voltage transformer relay from a number of remote locations.

The armature 28 carries a pair of electrical contacts which cooperate with a pair of stationary contacts to form a load switch 29. When the armature 28 contacts pole face 15 it carries the contacts thereon into contact with the stationary contacts to complete an electrical circuit to power a load. When rectifying switch 54 or 55 is momentarily moved to its off position the armature 28 is moved to pole face 14 separating the contacts and disconnecting the power to the load.

What is claimed is:

1. An electromagnetic device comprising:

a ferromagnetic core having opposed pole faces defining a gap;

a source of operating flux for establishing a magnetic field in said gap;

an armature mounted for selective contact with either of said pole faces;

a source of latching flux for retaining said armature in contact with either of said pole faces; and a flux return bracket contacting said source of latching flux and contacting said armature for conducting flux therebetween;

said source of latching flux having a surface area A perpendicular to the flux path and a length L along the flux path such that the factor L/A is less than 1, whereby said source of latching flux, said flux return bracket, and said armature provides a low reluctance path for a portion of the operating flux.

2. An electromagnetic device as in claim 1 wherein said source of latching flux comprises a permanent magnet.

3. An electromagnetic device as in claim 2 wherein said permanent magnet comprises domain size ferrite particles dispersed in a flexible nonmagnetic binder.

4. An electromagnetic device as in claim 2 further comprising a load switch mechanically actuated by said armature.

* * * * *